US011931637B2

(12) United States Patent
Frost et al.

(10) Patent No.: US 11,931,637 B2
(45) Date of Patent: Mar. 19, 2024

(54) SPORTS TRAINING AID

(71) Applicant: SURE-SET GOLF LTD, Weymouth (GB)

(72) Inventors: Daniel Alexander Frost, Poole (GB); Thomas Stuart Robson, Weymouth (GB); Michael Andrew Robson, Weymouth (GB)

(73) Assignee: SURE-SET GOLF LTD, Weymouth (GB)

( * ) Notice: Subject to any disclaimer, the term of this patent is extended or adjusted under 35 U.S.C. 154(b) by 183 days.

(21) Appl. No.: 17/020,395

(22) Filed: Sep. 14, 2020

(65) Prior Publication Data

US 2020/0406116 A1 Dec. 31, 2020

Related U.S. Application Data

(62) Division of application No. 16/072,800, filed as application No. PCT/EP2017/051494 on Jan. 25, 2017, now Pat. No. 10,773,144.

(30) Foreign Application Priority Data

Jan. 25, 2016 (GB) ..... 1601421

(51) Int. Cl.
*A63B 69/36* (2006.01)
*A63B 15/00* (2006.01)
*A63B 71/06* (2006.01)

(52) U.S. Cl.
CPC ..... *A63B 69/3632* (2013.01); *A63B 15/00* (2013.01); *A63B 69/3623* (2013.01); *A63B 2071/0694* (2013.01); *A63B 2225/09* (2013.01)

(58) Field of Classification Search
CPC . A63B 69/3632; A63B 15/00; A63B 69/3623; A63B 2071/0694; A63B 2225/09; A63B 60/22

(Continued)

(56) References Cited

U.S. PATENT DOCUMENTS 3,132,861 A * 5/1964 Horney ..... A63B 21/4045 482/46
3,170,690 A 2/1965 Goranson et al.
(Continued)

FOREIGN PATENT DOCUMENTS

DE 199 53 680 A1 5/2001
EP 0 029 872 A1 6/1981
(Continued)

OTHER PUBLICATIONS

Japanese Office Action, for Japanese Application No. 2018-557203, dated Jan. 12, 2021, 5 pages.
(Continued)

*Primary Examiner* — Nini F Legesse
(74) *Attorney, Agent, or Firm* — Seed IP Law Group LLP

(57) ABSTRACT

There is disclosed herein a sports training aid that may be useful in performing training exercises for improving, modifying or maintaining the swing, stroke or strike of an athlete or sportsperson, for sports such as tennis, table tennis, badminton, baseball, hockey, and fencing or other martial arts, and in particular golf, involving a club, bat, racquet or the like. The sports training aid includes a handle member and a spacing member that are configured to define a desired hand position relative to the torso of the athlete or sportsperson, and to maintain a desired relationship between the torso and hand position during the training exercise. The sports training aid may be adjustable to set the hand position relative to the torso differently for different exercises. The sports training aid may be modular and provide different training members attachable to the handle member, to facilitate practising different sporting actions, or different parts or variations of the same sporting action.

20 Claims, 10 Drawing Sheets

(58) Field of Classification Search
USPC ..... 473/219, 215, 226, 227, 231, 277, 294, 473/295, 296
See application file for complete search history.

(56) References Cited

U.S. PATENT DOCUMENTS

| | | | | |
|---|---|---|---|---|
| 3,184,234 | A * | 5/1965 | Struble | A63B 23/14 482/118 |
| 3,663,019 | A * | 5/1972 | Palotsee | A63B 53/007 473/295 |
| 4,170,356 | A | 10/1979 | Banks | |
| 4,203,591 | A * | 5/1980 | Gibson | A63B 23/14 482/46 |
| 4,249,762 | A | 2/1981 | Richards | |
| 4,557,479 | A * | 12/1985 | Guibert | A63B 21/4047 482/44 |
| 5,167,596 | A | 12/1992 | Ferber | |
| 5,520,392 | A | 5/1996 | Foresi et al. | |
| 5,536,223 | A * | 7/1996 | Ferber | A63B 21/00069 482/44 |
| 5,595,385 | A | 1/1997 | Jablonski | |
| 5,846,143 | A | 12/1998 | Brock et al. | |
| 6,533,676 | B1 | 3/2003 | D'Angelo et al. | |
| 6,659,880 | B1 | 12/2003 | Hsieh | |
| 6,773,378 | B2 * | 8/2004 | Bastyr | A63B 21/0004 482/114 |
| 7,244,187 | B2 * | 7/2007 | Brooks | A63B 69/3685 473/226 |
| 7,780,542 | B1 * | 8/2010 | Ross | A63B 69/3632 473/226 |
| 7,887,461 | B2 * | 2/2011 | Bakhtiyari | A63B 23/032 482/127 |
| 8,617,038 | B2 * | 12/2013 | Batiste | A63B 21/02 482/121 |
| 9,700,775 | B2 | 7/2017 | Hamilton et al. | |
| 2004/0082400 | A1 | 4/2004 | Yoshimura | |
| 2004/0176179 | A1 | 9/2004 | Johnson | |
| 2005/0049061 | A1 | 3/2005 | Skelley | |
| 2006/0035716 | A1 | 2/2006 | Brooks | |
| 2006/0079341 | A1 | 4/2006 | Mansour | |
| 2006/0142091 | A1 | 6/2006 | Berokoff | |
| 2007/0123398 | A1 | 5/2007 | Ljevaja | |
| 2007/0275788 | A1 | 11/2007 | Delpine | |
| 2011/0300962 | A1 | 12/2011 | Wright | |
| 2012/0088641 | A1 | 4/2012 | Shah | |
| 2015/0151159 | A1 * | 6/2015 | Davidow | G09B 19/003 434/257 |
| 2015/0165293 | A1 | 6/2015 | Hamilton et al. | |

FOREIGN PATENT DOCUMENTS

| | | | |
|---|---|---|---|
| GB | 2482105 | A | 1/2012 |
| JP | S58185255 | U | 12/1983 |
| JP | S60165972 | A | 8/1985 |
| JP | 2-74273 | A | 3/1990 |
| JP | 11-504531 | A | 4/1999 |
| JP | 2001353244 | A | 12/2001 |
| JP | 2004243068 | A | 9/2004 |
| JP | 3180735 | U | 1/2013 |
| WO | 2007/118298 | A1 | 10/2007 |

OTHER PUBLICATIONS

Japanese Office Action, for Japanese Application No. 2018-557203, dated Jan. 12, 2021, 9 pages (English translation).
International Search Report and Written Opinion, dated Jul. 7, 2017, for International Application No. PCT/EP2017/051494, 19 pages.
European Office Action, for European Application No. 17701328.1, dated Oct. 7, 2019, 5 pages.
Frost, "How to Configure the Sure-Set for Your Individual Golf Swing," YouTube Video, Sep. 17, 2015, URL=https://www.youtube.com/watch?v=XQA7Ewfrwug, download date Oct. 10, 2016, 1 page. (Screenshot).
United Kingdom Search Report, dated Sep. 8, 2016, for United Kingdom Application No. GB1611875.4, 6 pages.
Japanese Office Action, dated Sep. 20, 2022, for Japanese Patent Application No. 2021-164808. (6 pages) (with English Translation).
Japanese Office Action, dated May 8, 2023, for Japanese Patent Application No. 2021-164808. (8 pages) (with English Translation).

* cited by examiner

SPORTS TRAINING AID

TECHNICAL FIELD

The present invention relates to a sports training aid that may be useful for improving the swing, stroke or strike of an athlete or sportsperson, for sports involving a club, bat, racquet or the like, and to related training methods using the sports training aid. Such a sports training aid may be useful in training for many sports, such as tennis, table tennis, badminton, baseball, hockey and fencing or other martial arts, and may in particular be useful in training methods to improve all or part of a golfer's golf swing.

BACKGROUND

The training to improve, maintain or simply modify an athlete or sportsperson's performance for a skill-based sport (as opposed to training for power, strength, fitness or endurance, for example) essentially relies on repetition of specific movements in order to establish new neural pathways and secure them by assisting the myelination process. That is, by repeatedly performing an action consistently, a person's brain learns the movement and it becomes hard-wired into their neurological programming.

With advances in technology, the process of training athletes and sports people has become a science. In particular, beyond the modification of diet and training regimes adapted to specific sporting disciplines, climates and geographic locations, and tailored to achieve peak performance at specific sporting events, technology has permitted an increasingly close analysis of the bio-dynamics of sports. With the use of videography, 3D-modelling and devices to measure forces, pressure points and weight distribution, sports scientists are able to break down the complex motions which sports people and athletes perform when playing sport.

By breaking down a complex sporting action into smaller steps or parts of the motion, the effect of modifying each part of the motion can be assessed in terms of its effect on the overall action and resulting output. A training program can then be designed to target specific parts of the motion that the sportsperson or athlete may wish to improve, maintain or modify. For example, an athlete or sportsperson may wish to increase the speed of a swing at the point of impact, the accuracy and consistency of a shot, or to modify their existing action to reduce stress or pressure points, for example to accommodate or prevent an injury or other physical condition.

Even for the same sporting action, the requirements for any individual athlete or sportsperson are of course likely to be different, depending on each individual's size, strength, flexibility, range of motion and individual technique, as well as the desired outcome. In addition, in many sports, the same dominant action can be modified to produce a range of different shots or strokes, and the sportsperson or athlete may wish to follow a training program to improve or modify specific shots or strokes by focusing on a particular variation of the dominant action.

A golf swing is a sporting action that is particularly suited to such training methods, as the dominant action must be carried out repeatably and consistently in order to perform an accurate shot, and many different shot variations are possible based on the same dominant action. Because a golfer and the golf ball are static, a consistent swing can be practised that does not require the dynamic variation associated with sports where a moving ball has to be hit, requiring constant adjustment to the swing, stroke or strike in order to accommodate ongoing changes the sportsperson or athlete may need to make right up to the point of striking the ball. Nevertheless, there are many different factors which affect a sportsperson or athlete's golf swing, and using modern technology it is possible to break the swing into steps or stages and analyse each component of the swing separately. By training to improve, maintain or modify separate parts of a sportsperson or athlete's swing, the overall action can be trained to deliver a desired outcome.

It would therefore be desirable to provide a sports training aid suitable for use in training exercises to improve, maintain or modify one or more parts or aspects, or all, of a sporting action such as the swing, stroke or strike of an athlete or sportsperson, for sports involving a club, bat, racquet or the like.

SUMMARY OF THE INVENTION

According to a first aspect of the present invention, there is provided a sports training aid comprising an adjustable member between two arm members, the adjustable member being operable to set the two arms at a first fixed angle and at a second fixed angle but at no intermediate angle, wherein the first fixed angle is within the range from 45 to 55 degrees and the second fixed angle is within the range from 60 to 70 degrees.

According to a second aspect of the present invention, there is provided a sports training aid comprising: an elongate handle member extending from a hinge and having a defined grip portion along a first axis; a spacing member extending from the hinge to a positioning piece and being adjustable in length between the hinge and the positioning piece along a second axis; and wherein the hinge is rotatably adjustable about an axis of rotation between a first fixed position and a second fixed position, in each of which positions the hinge can be locked at a fixed angle between the first axis and the second axis, the angle between the first and second axes measured as projected onto a plane perpendicular to the axis of rotation of the hinge, wherein in the first fixed position the fixed angle is in the range from 45 degrees to 55 degrees, wherein in the second fixed position the angle is in the range from 60 degrees to 70 degrees, and wherein the hinge cannot be locked at any position between the first fixed position and the second fixed position.

According to a third aspect of the present invention, there is provided a sports training aid comprising two arm members joined together, a first of the two arm members extending from the join as an elongate handle member and the second of the two arm members extending from the join as a spacing member and defining a line of extension from the join to a positioning piece, wherein the arms are joined so that an angle between the handle member and the line of extension is set or is able to be set to a predetermined angle, the predetermined angle being in the range from 30 to 40 degrees and preferably substantially equal to 35 degrees.

According to a fourth aspect of the present invention, there is provided a sports training aid comprising: an elongate handle member having a defined grip portion and extending from a join along a first axis; a spacing member including a spacing arm extending from the join to a positioning piece to define a second axis from the join to the positioning piece; wherein the first and second axes are substantially coplanar and wherein the join is arranged such that an angle between the first axis and the second axis is or may be set to a predetermined angle, and wherein the predetermined angle is in the range from 30 degrees to 40 degrees.

According to a fifth aspect of the present invention, there is provided a sports training aid comprising an adjustable member between two arm members, the adjustable member being operable to set the two arm members at a fixed angle within the range from 60 to 70 degrees, a first of the two arm members extending as an elongate handle member and the second of the two arm members forming part of a spacing member and being joined at a joint to a spacing arm extending from the joint to a positioning piece, the joint being angled such that the spacing arm is angled towards the first arm member and extends at a bend angle in the range from 30 to 35 degrees relative to the second arm member.

According to a sixth aspect of the present invention, there is provided a sports training aid comprising: a first arm member forming an elongate handle member extending from a hinge and having a defined grip portion along a first axis; a second arm member extending from the hinge along a second axis to an angled joint; and a spacing arm extending from the joint to a positioning piece and defining a line of extension from the centre of rotation of the hinge to the positioning piece, wherein the hinge is rotatably adjustable about an axis of rotation and can be locked at a predetermined angle between the first axis and the second axis, the predetermined angle between the first and second axes measured as projected onto a plane perpendicular to the axis of rotation of the hinge, wherein in the predetermined angle is in the range from 60 degrees to 70 degrees, wherein the spacing arm is angled at a bend angle towards the first axis relative to the second axis, the bend angle between the spacing arm and the second axis measured as projected onto the plane perpendicular to the axis of rotation of the hinge, and wherein the bend angle is in the range from 30 degrees to 35 degrees.

According to a seventh aspect of the present invention, there is provided a sports training aid comprising two arm members joined together so that an angle between the two arm members is set or is able to be set to a predetermined angle, a first of the two arm members extending as an elongate handle member and the second of the two arm members forming part of a spacing member and being joined at a joint to a spacing arm extending from the joint to a positioning piece, the joint being angled such that the spacing arm is angled towards the first arm member and extends at a bend angle relative to the second arm member, wherein the joint permits the spacing arm to rotate relative to the first arm member about an axis substantially aligned with the second arm member.

According to an eighth aspect of the present invention, there is provided a sports training aid comprising: a first arm member forming an elongate handle member having a defined grip portion and extending from a join along a first axis; and a spacing member including: a second arm member extending from the join along a second axis to an angled joint; and a spacing arm extending from the angled joint to a positioning piece and defining a line of extension from the angled joint to the positioning piece, wherein the first and second axes are substantially coplanar and wherein the join is arranged such that an angle between the first axis and the second axis measured in the plane is or may be set to a predetermined non-zero angle, wherein the line of extension is angled at a bend angle towards the first axis relative to the second axis, and wherein the joint permits the spacing member to rotate about an axis of rotation substantially aligned with the second axis such that the line of extension rotates relative to the plane of the first and second axes.

According to a ninth aspect of the present invention, there is provided a sports training aid comprising two arm members joined together, a first of the two arm members extending from the join as an elongate handle member and the second of the two arm members extending from the join as part of a spacing member and defining a line of extension from the join to a positioning piece, wherein the arms are joined so that an angle between the handle member and the line of extension is set or is able to be set to one or more predetermined angles, wherein the elongate handle member includes a defined grip portion that is able to twist about an axis of the handle member relative to the rest of the handle member.

According to a tenth aspect of the present invention, there is provided a sports training aid comprising: an elongate handle member having a defined grip portion and extending along a first axis from a join; and a spacing member extending from the join to a positioning piece to define a second axis from the join to the positioning piece, wherein the first and second axes are substantially coplanar and wherein the join is arranged such that an angle between the first axis and the second axis is or may be set to one or more predetermined angles, and wherein the grip portion is able to twist about the first axis relative to the rest of the handle member.

According to an eleventh aspect of the present invention, there is provided a sports training aid comprising an elongate handle member joined at a join to a spacing member, the spacing member defining a line of extension from the join to a positioning piece, wherein the elongate handle member and the spacing member are joined so that an angle between the handle member and the line of extension is fixed at a predetermined angle, the predetermined angle being in the range from 30 to 40 degrees or in the range from 45 to 55 degrees or in the range from 60 to 70 degrees.

According to a twelfth aspect of the present invention, there is provided a sports training aid comprising: an elongate handle member having a defined grip portion and extending from a join along a first axis; and a spacing member extending from the join to a positioning piece to define a second axis from the join to the positioning piece, wherein the first and second axes are substantially coplanar and wherein the join is arranged such that an angle between the first axis and the second axis is fixed at a predetermined angle, and wherein the predetermined angle is in the range from 30 to 40 degrees or in the range from 45 to 55 degrees or in the range from 60 to 70 degrees.

According to a thirteenth aspect of the present invention, there is provided a golf training aid comprising: an attachment member attachable to the shaft of a golf club; and a spacing member arranged to extend from the attachment member at an angle relative to the golf club and terminating in a positioning piece, wherein the spacing member is arranged so as to facilitate holding of the positioning piece in contact with a golfer's torso when the attachment member is attached to the shaft of a golf club and the golf club is held in the golfer's hands in a golf grip with the golfer's arms substantially straight.

According to a fourteenth aspect of the present invention, there is provided a modular training member comprising a training member connector part that is disconnectably connectable to a handle connector part of an elongate handle member to form a sports training aid, wherein the modular training member includes one or more of the following:

a) a spacing member arranged to extend from the training member connector part to a positioning piece such that when the training member is connected to the handle member the spacing member extends at an angle relative to the handle member;

b) a shaft arranged to extend from the training member connector part such that when the training member is connected to the handle member it extends in substantially the same direction as the handle member, the shaft having a flag mounted thereon spaced from the training member connector part;

c) a shaft arranged to extend from the training member connector part such that when the training member is connected to the handle member it extends in substantially the same direction as the handle member, the shaft having a brush mounted at one end thereof opposite to the training member connector part; and d) a face indicator to indicate alignment of the elongate handle member when the training member is connected to the handle member.

According to a fifteenth aspect of the present invention, there is provided a modular sports training aid comprising: an elongate handle member having a handle connector part at one end; and one or more modular training members each having a training member connector part that is disconnectably connectable to the handle connector part, wherein the or each modular training member is adapted, when connected to the elongate handle member, for use in training all or part of a sporting action.

BRIEF DESCRIPTION OF THE DRAWINGS

To enable a better understanding of the present invention, and to show how the same may be carried into effect, reference will now be made, by way of example only, to the accompanying drawings, in which.

DETAILED DESCRIPTION

Figure 1:
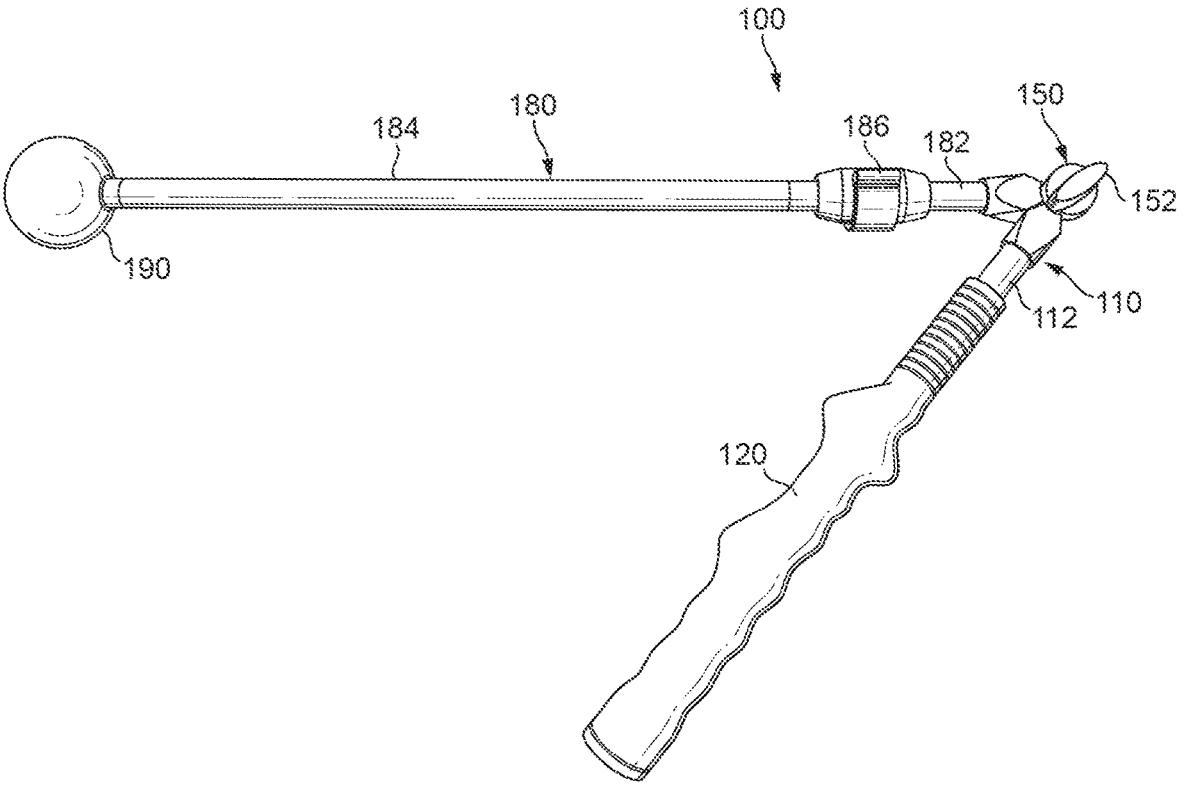
FIG. 1 shows a first embodiment of a sports training aid according to the present invention having a telescopically extendable spacing member, with the spacing member shown in the retracted, minimum-length configuration.

Embodiments of the present invention will now be described with reference to the accompanying drawings figures. In these embodiments, reference is made specifically to a sports training aid suitable for practising one or more aspects of a golf swing. Nevertheless, it will be appreciated that similar or identical sports training aids may be used in training routines relevant to many different sports, such as tennis, table tennis, badminton, baseball, hockey and fencing or other martial arts. In particular, embodiments of the sports training aid of the present invention can encourage the sportsperson or athlete to maintain a greater extension of their arm in the load phase or backswing part of a sporting action, which can facilitate delivering greater rotation, leverage, momentum and swing speed in a controlled and repeatable motion when unloading into the forward swing, stroke or strike. Therefore, the present invention should be understood to include sports training aids adapted for use in training programmes for other sports, besides golf.

Furthermore, in the following, any stated ranges are intended to include the mentioned end values. It should also be understood that where two members are said to be locked, fixed or set in position relative to one another, this means that their relative position is held so that it will not change during normal use of the sports training aid. Two members which are locked, fixed or set in position may be permanently so locked, fixed or set, or they may be releasably so locked, fixed or set to enable their relative position to be adjusted.

A first embodiment of the sports training aid 100 is shown in FIGS. 1 to 4. The sports training aid includes an elongate handle member 110 joined to a spacing member 180.

In the embodiment of FIGS. 1 to 4, the elongate handle member 110 is joined to the spacing member 180 by an adjustable member which allows the angle set between the elongate handle member 110 and the spacing member 180 to be changed. In the case of the embodiment of FIGS. 1 to 4, this is achieved by providing a lockable hinge 150 as the adjustable member, allowing the angle between the elongate handle member 110 and the spacing member 180 to be varied, and then locked so as to set the angle between the elongate handle member 110 and the spacing member 180 to the desired angle.

The adjustable member need not be a hinge, however, and any other suitable mechanism may be employed for adjusting the angle between the elongate handle member 110 and spacing member 180. Furthermore, in alternative embodiments according to the present invention, the join between the elongate handle member 110 and the spacing member 180 need not provide adjustability, and the angle of the elongate handle member 110 relative to the spacing member 180 may be fixed. This may be achieved, for example, by the elongate handle member 110 being joined to the spacing member 180 by being moulded, or otherwise formed as a unitary piece, together with the spacing member 180.

In the case of the embodiment of FIGS. 1 to 4, the hinge 150 includes a first arm member 112 extending from the hinge 150 to form part of the elongate handle member 110. A second arm member 182 extends from the hinge 150 and forms part of the spacing member 180.

The elongate handle member 110 includes a grip portion 120 which extends along a portion of the first arm member 112.

Figure 2:
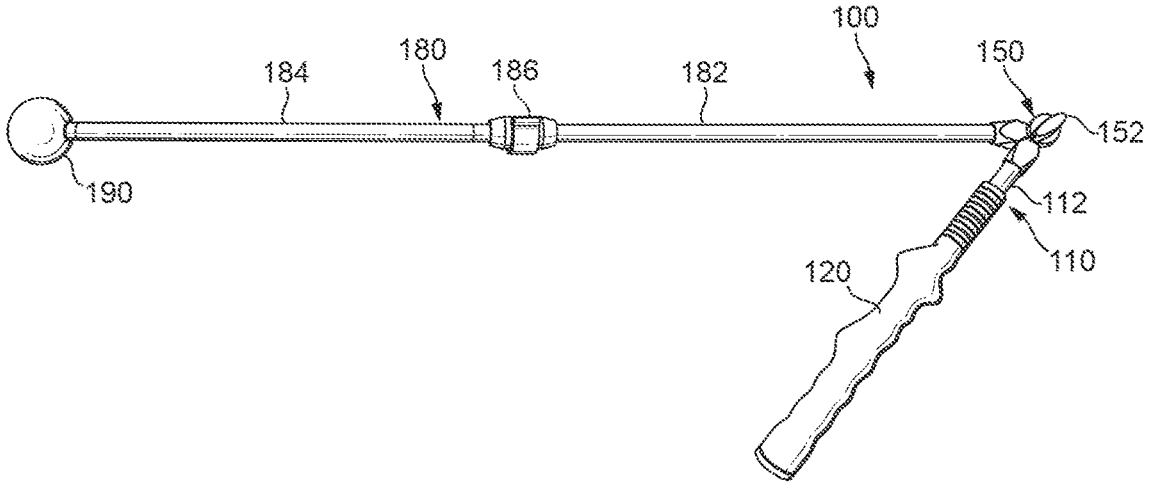
FIG. 2 shows the sports training aid of FIG. 1, with the telescopically extendable spacing member shown in the fully-extended, maximum-length configuration.

As shown in FIGS. 1 and 2, the defined grip portion 120 is preferably shaped to define a predetermined position and orientation for the elongate handle member 110 within a user's grip. The grip portion 120 is that part of the handle member 110 which the user's hands come in contact with when holding the handle member in the predetermined position and orientation. In the case of the embodiment of FIGS. 1 to 4, the grip is shaped so as to encourage a user's hands into the position of a two-handed golf grip, which will also determine the orientation of the rest of the sports training aid 100 relative to the user, when the grip portion 120 of the elongate handle member 110 is held by the user in the intended way. Such a grip can be left- or right-handed, and in either case may be moulded or otherwise shaped to define the preferred grip position for one or both hands. The shape and arrangement of the defined grip may of course be adapted for embodiments of the sports training aid intended for use with different sports, other than golf, and may define one or more hand positions for single-handed or double-handed grips.

In the embodiment of FIGS. 1 to 4, the spacing member 180 includes second arm member 182 extending from the hinge 150 together with an outer spacing member 184 that is able to slide telescopically along the second arm member 182, and which can be locked via a locking mechanism 186 so as to set the length of the spacing member at a correct or desired length for a particular user or for use in a particular training exercise. Of course, in alternative embodiments, the second arm member 182 could form the outer spacing member, and an inner shaft member could slide telescopically within the second arm to provide equivalent functionality to that provided by the spacing member 180 shown in FIGS. 1 to 4. It is also possible for more than two members to be arranged to slide telescopically relative to one another.

The spacing member terminates in a positioning piece 190, which is preferably formed as a ball, as shown in FIGS. 1 and 2, although other shapes and arrangements are possible. In this embodiment, the ball is separately formed and attached to the end of the outer spacing member 184, but in other embodiments the positioning piece 190 may be integrally moulded or otherwise formed together with the spacing member 180. A ball or ball-shaped positioning piece 190 is preferred as this allows the user to feel the desired contact point of the positioning piece 190 on their torso without placing additional constraints on their freedom of movement, and facilitates maintaining the positioning piece 190 in contact with the user's torso as they move their arms in the swing, stroke or strike action. This provides a tactile feedback to the sportsperson or athlete as they use the sports training aid 100, as they can feel if and when contact with the positioning piece 190 is lost or moves to another position.

The sports training aid 100 is configured to be held in a two-handed golf grip by a user, with the elongate handle member 110 extending forwards and upwards from the user's grip in the direction of the hinge 150, and with the spacing member 180 angled back towards the user by the hinge 150, so that the positioning piece 190 is held in contact with the user's torso. The length of the spacing member 180 is adjustable so as to accommodate the requirements of different users, dependent on their relative height, size and body shape.

Figure 17:
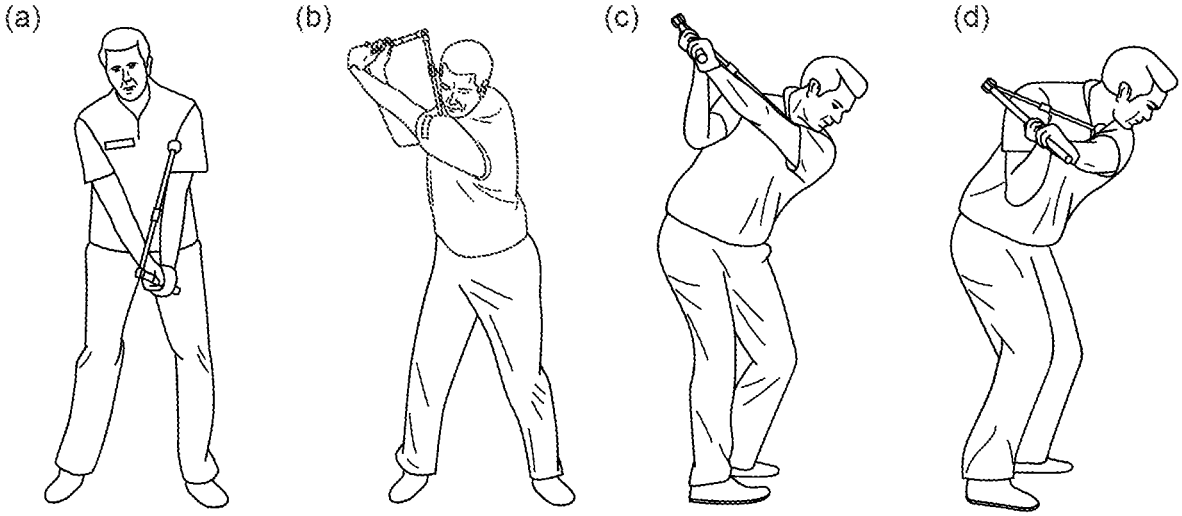
FIG. 17 shows a sportsperson using the sports training aid of FIGS. 1 to 4 in a sequence of steps (a), (b) and (c), and (d), in which, in step (a) the sportsperson is in a set position with the positioning piece of the sports training aid held in contact with the sportsperson's torso adjacent the left armpit, in step (b) and (c) the sportsperson is viewed in the same position from two different angles in a load phase of the sporting action being practised, with the positioning piece still held in contact with the sportsperson's torso, and in step (d) an initial unloading has taken place relative to the load phase of step (b) and (c), at the start of the downswing action, with the positioning piece of the sports training aid remaining in contact with the torso of the sportsperson.

Once the length of the spacing member 180 has been set correctly for the particular user, the length of the spacing member 180 together with the angle defined at the join between the spacing member 180 and the elongate handle member 110 define a desired hand, wrist and arm position and orientation for the user when the positioning piece 190 is in contact with the user's torso. The user is therefore encouraged to adopt a desired set position when holding the sports training aid 100, as shown in FIG. 17(*a*).

In the embodiment of FIGS. 1 to 4, the spacing member 184 has a retracted, minimum length, as measured from the centre of rotation of the hinge 150 to the end of the ball-shaped positioning piece 190, of 47 cm. This is in order to accommodate smaller users, and also allows the sports training aid to be made compact for storage and transport. The minimum length of the spacing member 180 between the centre of rotation of the hinge 150 and the end of the positioning piece 190 may be set according to design preference, but a minimum length of the spacing member in the retracted, minimum-length configuration is contemplated to be between 35 and 50 cm. Similarly, as shown in FIG. 2, the spacing member 180 of the embodiment of FIGS. 1 to 4 has a maximum, fully-extended length, from the centre of rotation of the hinge 150 to the end of the ball-shaped positioning piece 190, of 78 cm. Again, however, spacing members are contemplated having a maximum length in the range from 70 to 100 cm. Furthermore, there are many conceivable mechanisms for providing an extendable spacing member, not only the telescoping spacing member 180, and any suitable mechanism may be employed to adjust the spacing of the positioning piece 190 relative to the hinge 150.

An extendable spacing member 180 is desirable not only to accommodate differently sized users, but also to accommodate adjustment of the sports training aid 100 by the same user for use in different training exercises. However, embodiments of the sports training aid are contemplated in which the spacing member 180 is non-adjustable, the user selecting or purchasing a sports training aid appropriate to their size and for use in a particular training exercise.

Nevertheless, the present application principally contemplates an adjustable sports training aid, not only to facilitate the sports training aid being used by different users of different sizes, but also so as to be adaptable for use by the same user in training different aspects of a sports action. In the case of golf, the sports training aid may be adaptable for use in performing training exercises focused on different parts of the same golf swing, or for practising and training for different swings associated with different golf clubs and/or different golf shots played with the same golf club.

Figure 3:
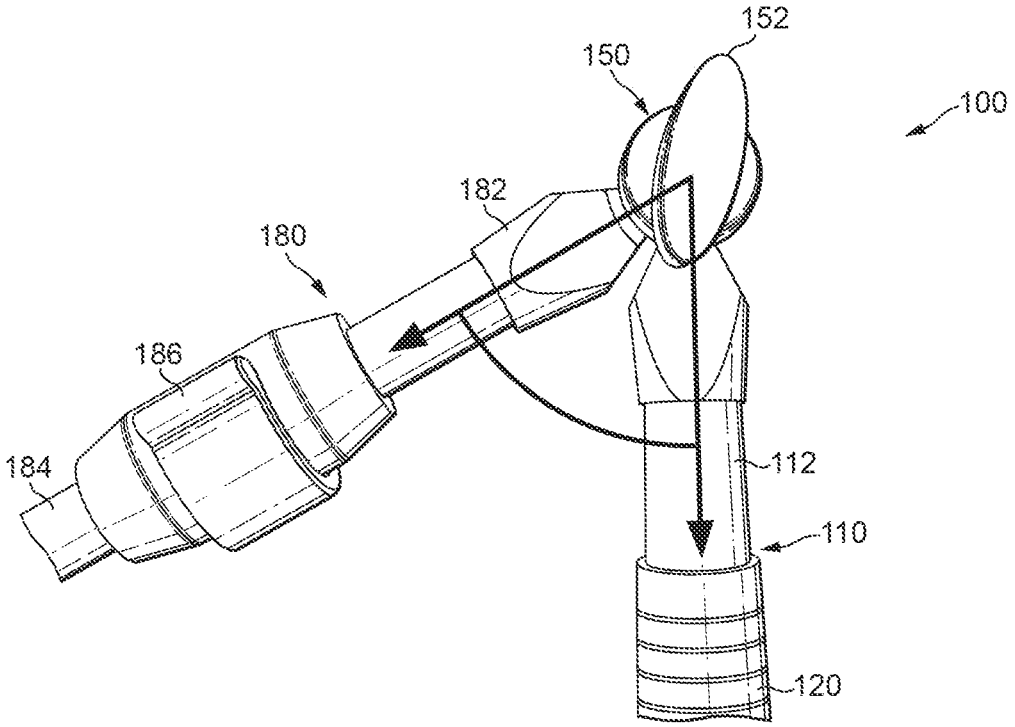
FIG. 3 shows an enlarged view of the hinge of the sports training aid of FIGS. 1 and 2, with an angle between the spacing member and handle member set to 65 degrees.
Figure 4:
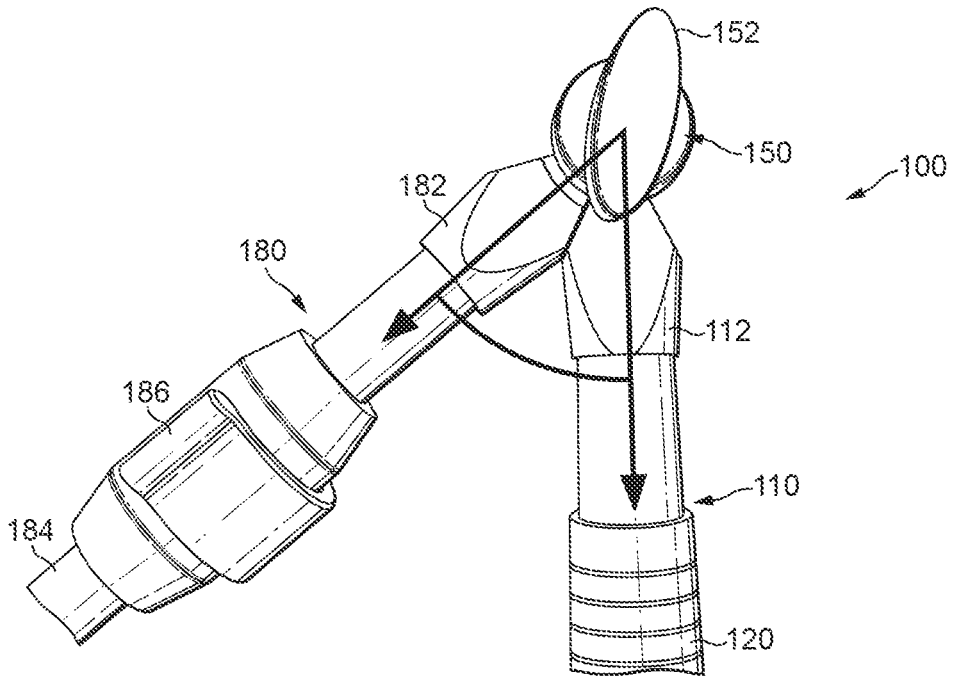
FIG. 4 shows an enlarged view of the hinge of the sports training aid of FIGS. 1 and 2, with an angle between the spacing member and handle member set to 50 degrees.

In this regard, turning to FIGS. 3 and 4, the hinge 150 of the sports training aid 100 of FIGS. 1 to 4 is adapted so as to define two predetermined set angles, which represent the preferred configurations for practising two different golf swings associated with different golf clubs.

In particular, as shown in FIG. 3, an angle of 65 degrees is set at the hinge 150 between the first arm 112 which forms part of the elongate handle member 110 and the second arm 182 which forms part of the spacing member 180. In FIG. 3, the angle is set to 65 degrees, and represents a standard angle that might be associated with training for the use of golfing irons, for practising the most commonly used golf swing that is applicable to use with the majority of golf clubs. The standard angle is preferably set to a value in the range from 60 to 70 degrees.

By contrast, as shown in FIG. 4, the hinge 150 can be adjusted to a second set position at which the angle between the first arm 112 and the second arm 182 is set to 50 degrees, which corresponds to an angle representative of using a golf driver. The driver angle is preferably set to a value in the range from 45 to 55 degrees. Preferably the driver angle is at least 10 degrees smaller than the standard angle, more preferably 15 degrees smaller than the standard angle.

The hinge 150 shown in FIGS. 3 and 4 has a hinge locking mechanism 152 that is able to lock the hinge 150 in each of the positions indicated. Locking hinge mechanisms of this type are known for various applications, and it would be conceivable to provide a hinge which has an infinitely variable angular position, so that the hinge can be locked or set at any desired position between the first and second arm members 112, 182. However, the sports training aid 100 of the embodiment of FIGS. 1 to 4 provides only a limited number of lockable positions for the hinge 150, so as to provide predetermined set points corresponding to preferred training exercises that the sportsperson or athlete may perform with the sports training aid 100. As such, the sports training aid of FIGS. 1 to 4 does not include any position between that shown in FIGS. 3 and 4 at which the hinge 150 can be locked, i.e. there is no intermediate lockable position for the hinge 150 between the angles of 50 degrees and 65 degrees defined by the first and second arms 112, 182.

This configuration is intended to allow users to identify easily the desired set positions for the sports training aid 100 corresponding to predefined training exercises representative of the golf swing used when playing an iron shot (FIG. 3) or when playing a drive shot (FIG. 4). Being able to assuredly return the hinge 150 to the same position ensures repeatability of the training exercise without unintended variations in the configuration of the sports training aid 100 which could alter the resulting physical motion which is being trained.

It should be noted that the embodiment of FIGS. 1 to 4 does provide an additional lockable position for the hinge 150, for an angle substantially equal to 180 degrees between the first and second arm members 112, 182. This is to facilitate the sports training aid being easily stored and carried, for example in a golf bag or holdall.

Although not shown for the embodiment of FIGS. 1 to 4, it is also contemplated that an additional reduced angle in the range from 30 to 40 degrees, preferably 35 degrees, could be provided as a lockable position for the hinge 150, in order to be representative of a pitching shot. The pitching shot again requires a different overall swing motion, necessitating a different hand position relative to the user's stance, as defined and encouraged by the angular position at the hinge 150 when the sports training aid is set to such an angle.

It will be appreciated that, in general, the length of the spacing member 180 also has to be adjustable in order to accommodate the different angular positions at the hinge 150, in order to maintain the positioning piece 190 in contact with the user's torso when performing a training action, for example, as shown in FIGS. 17(*a*) to (*d*). Conversely, it is anticipated that a sports training aid which does not have an adjustable join between the elongate handle member 110 and the spacing member 180 will also not have an adjustable-length spacing member. Nevertheless, the spacing member 180 might still be made adjustable in length even where the join is permanently fixed at a predetermined angle, in order to adjust the length of the spacing member 180 to users of different sizes.

It should be noted that where the join is not adjustable, or where no hinge is provided, the length of the spacing member 180 should be taken to be the distance from the point where the axes of the elongate handle member 110 and the spacing member 180 cross to the end of the positioning piece. If the elongate handle member 110 is not straight, and/or the spacing member 180 is not straight, the effective length of the spacing member may be taken to be from a nominal hinge point located on a longitudinal axis which passes centrally through both ends of the defined grip portion, 11 cm in front of where the defined grip portion ends, to the end of the positioning piece. In this context, the end of the positioning piece 190 is taken to be the point on the positioning piece 190 that is intended to engage a user's torso and is located furthest from the nominal hinge point.

Similarly, where a hinge is provided but the elongate handle member 110 is not straight, and/or the spacing member 180 is not straight, the effective angle between the elongate handle member and the spacing member may be determined as the angle defined at the above nominal hinge point, being the angle at that point between the longitudinal axis which passes centrally through both ends of the defined grip portion and the line of extension from that point to the end of the positioning piece.

Turning to FIGS. 5 to 12, a second embodiment of a sports training aid 200 according to the present invention is shown. Similarly to the first embodiment shown in FIGS. 1 to 4, the sports training aid 200 includes an elongate handle member 210 joined to a spacing member 280.

The elongate handle member 210 is joined to the spacing member 280 by an adjustable member which allows the angle set between the elongate handle member 210 and the spacing member 280 to be changed. As with the preceding embodiment, this is achieved by providing a lockable hinge 250 as the adjustable member, allowing the angle between the elongate handle member 210 and the spacing member 280 to be varied, and then locked so as to set the angle between the elongate handle member 210 and the spacing member 280 to the desired angle.

As with the embodiment of FIGS. 1 to 4, the adjustable member need not be a hinge, and any other suitable mechanism may be employed for adjusting the angle between the elongate handle member 210 and the spacing member 280. Furthermore, in alternative embodiments according to the present invention, the join between the elongate handle member 210 and the spacing member 280 need not provide adjustability, and the angle of the elongate handle member 210 relative to the spacing member 280 may be fixed.

In the embodiment of FIGS. 5 to 12, the hinge 250 includes a first arm member 212 extending from the hinge 250 to form part of the elongate handle member 210. A second arm member 230 extends from the hinge 250 and forms part of the spacing member 280. A locking mechanism 252 is provided to lock the first arm member 212 and the second arm member 230 in position relative to one another.

Figure 5:
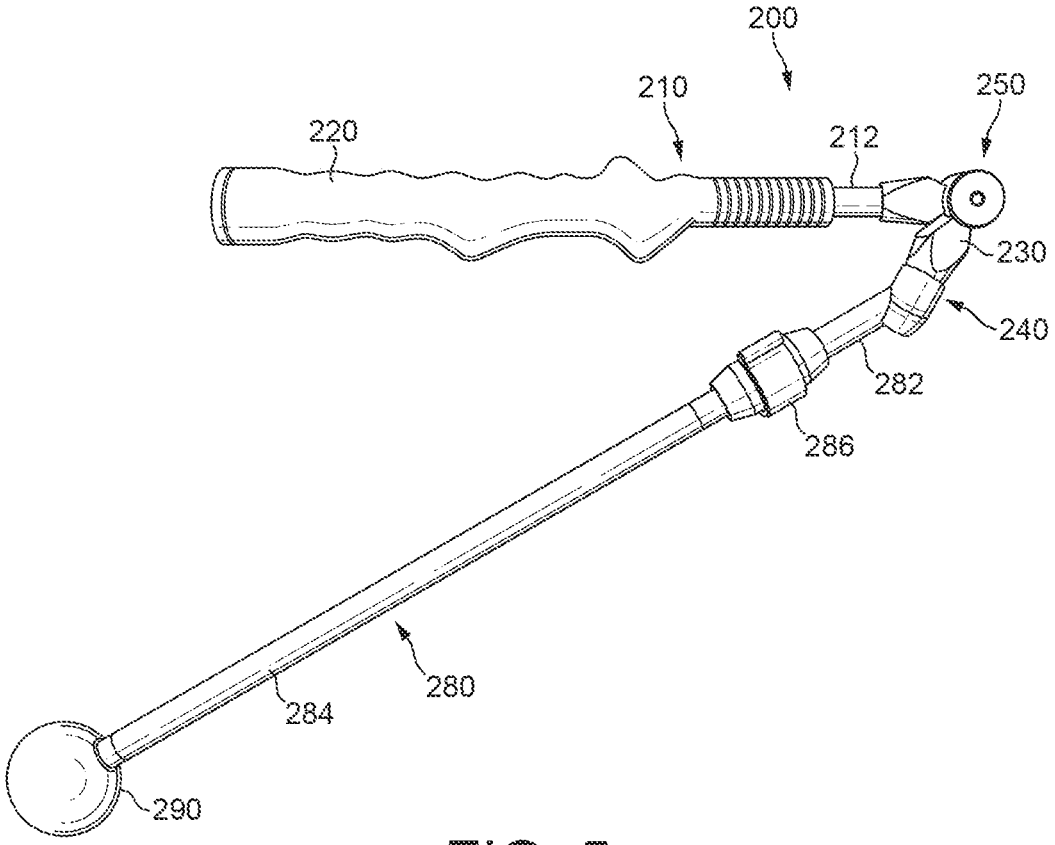
FIG. 5 shows a second embodiment of a sports training aid according to the present invention having a telescopically extendable spacing member, with the spacing member shown in the retracted, minimum-length position.
Figure 6:
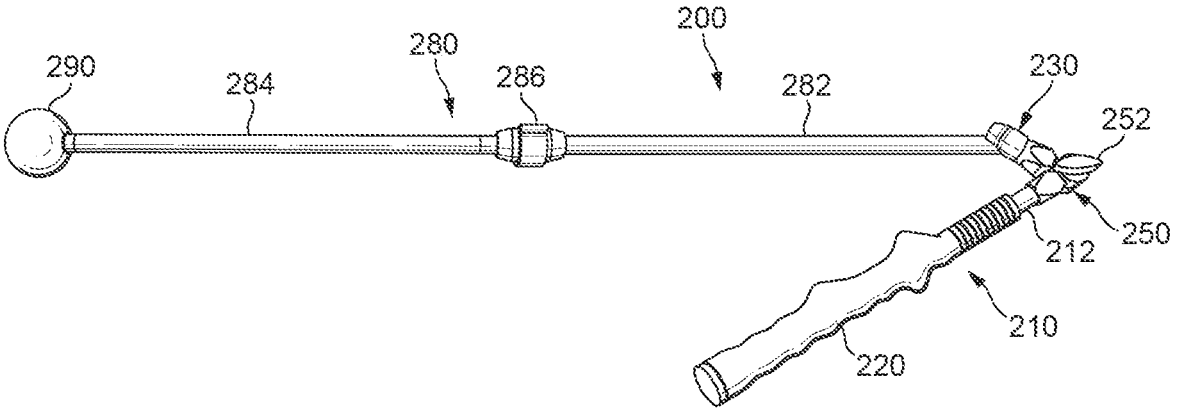
FIG. 6 shows the sports training aid of FIG. 5 with the telescopically extendable spacing member shown in the fully-extended, maximum-length configuration.

The elongate handle member 210 includes a grip portion 220 which extends along a portion of the first arm member 212. As shown in FIGS. 5 and 6, the defined grip portion 220 is preferably shaped to define a predetermined position and orientation for the elongate handle member 210 within a user's grip. The grip portion 220 is that part of the handle member 210 which the user's hands come in contact with when holding the handle member in the predetermined position and orientation. In the case of the embodiment of FIGS. 5 to 12, the grip is shaped so as to encourage a user's hands into the position of a two-handed golf grip, which will also determine the orientation of the rest of the sports training aid 200 relative to the user, when the grip portion 220 of the elongate handle member 210 is held by the user in the intended way. Such a grip can be left- or right-handed and in either case may be moulded or otherwise shaped to define the preferred grip position for one or both hands. As noted above, the shape and arrangement of the defined grip may of course be adapted for embodiments of the sports training aid intended for use with different sports, other than golf, and may define one or more hand positions for single-handed or double-handed grips.

In the embodiment of FIGS. 5 to 12, the spacing member 280 includes second arm member 230 extending from the hinge 250 to an angled joint 240. A spacing arm extends from the angled joint 240 and terminates in a positioning piece 290. As shown in FIGS. 5 and 6, the spacing arm is formed so as to be telescopically extendable, and comprises an inner spacing arm 282 extending from the angled joint 230 together with an outer spacing arm 284 that is able to slide telescopically along the outside of the inner spacing arm 282, and which can be locked via a locking mechanism 286 so as to set the length of the spacing arm at a correct or desired length for a particular user or for use in a particular training exercise. As noted above, in alternative embodiments, the outer spacing arm 284 could extend from the angled joint 230, with the inner spacing arm able to slide telescopically within the outer spacing arm 284 and being connected at its terminal end to the positioning piece 290. Again, it would also be possible for the spacing arm to be formed from more than two spacing arms arranged to slide telescopically relative to one another.

The positioning piece 290, as with the embodiment of FIGS. 1 to 4, is preferably formed as a ball, as shown in FIGS. 5 and 6. Again, other shapes and arrangements are possible. In the present embodiment, the ball-shaped positioning piece 290 is separately formed and then attached to the end of the outer spacing arm 284, but in other embodiments the positioning piece 290 may be integrally moulded or otherwise formed together with the spacing arm 280. A ball or ball-shaped positioning piece 290 is preferred for the same reasons as mentioned above in respect of the embodiment of FIGS. 1 to 4.

The sports training aid 200 is configured to be used in the same way as the sports training aid 100 of FIGS. 1 to 4, namely by being held in a two-handed golf grip by a user, with the elongate handle member 210 extending forwards and upwards from the user's grip in the direction of the hinge 250, and with the spacing member 280 angled back towards the user by the hinge 250, so that the positioning piece 290 is held in contact with the user's torso. The length of the spacing member 280 is adjustable by the telescopic spacing arm, so as to accommodate the requirements of different users, dependent on their relative height, size and body shape.

As with the embodiment of FIGS. 1 to 4, once the length of the spacing member 280 has been set correctly for the particular user, the length of the spacing member 280 together with the angles defined at the hinge 250 and the angled joint 240 define a desired hand, wrist and arm position and orientation for the user when the positioning piece 290 is in contact with the user's torso. The user is therefore encouraged to adopt a desired set position, in a similar manner to that shown in FIG. 17(*a*). As compared with the embodiment of FIGS. 1 to 4, the sports training aid 200 shown in FIGS. 5 to 12 is arranged so as to have a reduced angle between the spacing member 280 and the elongate handle member 210, this defining a desired hand, wrist and arm position approximating that used with a golf pitching wedge, as opposed to the standard iron position or the driver position approximated with the sports training aid 100 of FIGS. 1 to 4 as described above.

As shown in FIGS. 5 and 6, the spacing member 184 has a retracted, minimum length, as measured from the centre of rotation of the hinge 250 to the end of the ball-shaped positioning piece 290, of 49 cm. This is in order to accommodate smaller users, and also allows the sports training aid to be made compact for storage and transport.

The minimum length of the spacing member 280 between the centre of rotation of the hinge 250 and the end of the positioning piece 290 may be set according to design preference, but a minimum length of the spacing member 284 in the retracted, minimum-length configuration is contemplated to be between 35 and 50 cm. Similarly, as shown in FIG. 6, the spacing member 280 of the sports training aid 200 has a maximum, fully-extended length from the centre of rotation to the hinge 250 to the end of the ball-shaped positioning piece 290, of 80 cm. The maximum length configuration of the spacing member may of course vary with design, but spacing members having a maximum length in the range from 70 to 100 cm are contemplated. Furthermore, as mentioned above, a telescoping spacing arm is not the only conceivable mechanism for adjusting the length of the spacing member 280, and other suitable mechanisms may be employed to adjust the spacing of the positioning piece 290 relative to the hinge point of hinge 250.

An extendable spacing member 280 may be desirable, so that a common design can be adopted by users of different sizes, and so that the sports training aid 200 may be adjusted for use in different training exercises by the same user. Nevertheless, embodiments of the sports training aid are contemplated in which the spacing arm is non-adjustable, the user selecting or purchasing a sports training aid appropriate to their size and for use only in a specific or limited number of training exercises.

The sports training aid 200 of FIGS. 5 to 12 is, however, principally contemplated for use in training to improve, modify or maintain aspects associated with a golf pitching swing, and is particularly adapted in a number of respects for this purpose.

Figure 7:
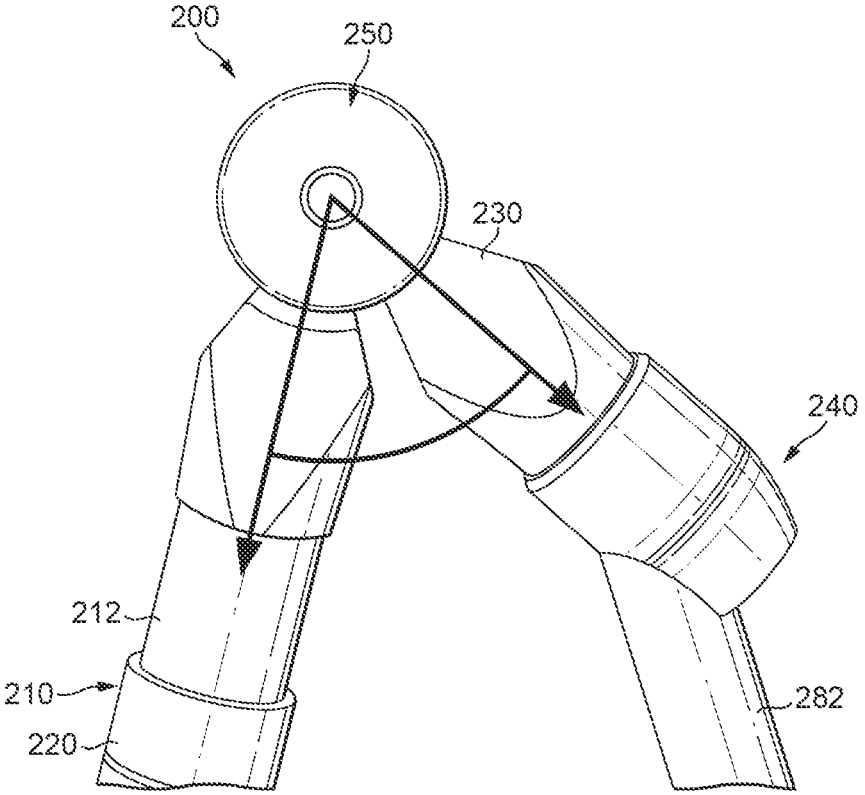
FIG. 7 shows an enlarged view of the hinge and angled joint of the sports training aid of FIGS. 5 and 6, with an angle of 65 degrees between the first and second arm members of the hinge.
Figure 8:
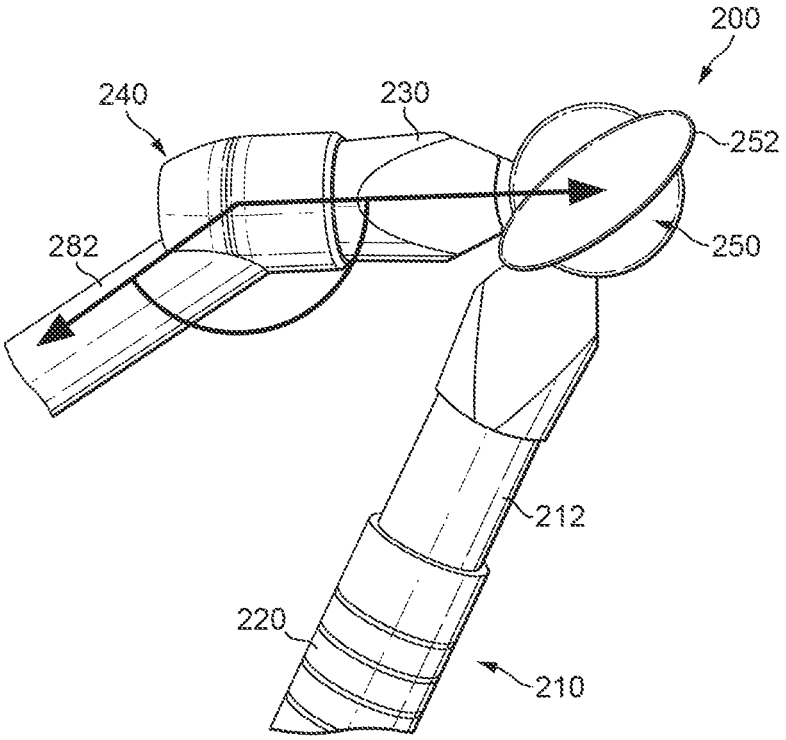
FIG. 8 shows an enlarged view of the hinge and angled joint of the sports training aid of FIGS. 5, 6, with an angle of 147.5 degrees between the second arm member of the hinge and the spacing arm.

With reference to FIGS. 7 and 8, the hinge 250 and angled joint 240 of the sports training aid 200 of FIGS. 5 to 12 are shown enlarged, with the hinge 250 in a preferred orientation, establishing a standard angle of 65 degrees between the first arm member 212 and the second arm member 230 of the hinge 250, the same as the standard angle used in the hinge 150 of the sports training aid 100 of FIGS. 1 to 4. According to design preferences, the predetermined angle at the hinge may be from 60 to 70 degrees. Again, as with the lockable hinge 150 of the embodiment of FIGS. 1 to 4, the hinge 250 of the sports training aid 200 may be set so as to define a limited number of specific positions at which the hinge 250 may be locked. Notably, the hinge 250 used in the sports training aid 200 may be the same as the hinge 150 used in the sports training aid 100, thereby allowing the same componentry to be used for both models of the sports training aid. Alternatively, the hinge 250 may be infinitely adjustable, so as to allow a wide range of different angular positions to be obtained between the first arm member 212 and the second arm member 230 of the hinge 250. This is achieved in the embodiment of FIGS. 5 to 12, as seen in FIGS. 9 to 12, by providing the two relatively rotating parts of hinge 250 with a large number of interlocking teeth 253 that can be engaged and locked in place by locking mechanism 252 at a large number of regularly spaced angular positions defined by the interlocking teeth.

Unlike with the sports training aid 100 of FIGS. 1 to 4, the second arm 230 of the hinge 250 of the sports training aid 200 of FIGS. 5 to 12 does not extend in a straight line to the positioning piece 290. Instead, the second arm member 230 of the hinge 250 is connected to the inner spacing arm 282 via an angled joint 240. As shown in FIG. 8, the angled joint 240 defines a bend in the spacing member 280 such that the inner spacing arm 282 is angled inwardly towards the elongate handle member 210 relative to the second arm member 230 of the hinge 250. The inner spacing arm 282 is bent inwardly from the axis of the second arm member 230 towards the elongate handle member 210 by an angle of 32.5 degrees, so as to define an internal angle of 147.5 degrees between the axis of the second arm member 230 of the hinge 250 and the axis of the inner spacing arm 282. The internal angle at the angled joint may be set within a range from 142.5 to 152.5 degrees.

The bend provided by the angled joint 240 effectively reduces the angle between the inner (and outer) spacing arm 282 (and 284) and the elongate handle member 210 to 32.5 degrees, which affects the angle experienced by the user when holding the grip portion 220 of the handle member 210 as intended. The angle between the spacing arm and the elongate handle member 210 may be between 30 and 35 degrees.

As measured between the line of extension of the spacing member 284, which extends from the centre of rotation of the hinge 250 to the end of the positioning piece 290, and the axis of the elongate handle member 210, in the manner explained above, the angle between the spacing member 280 and the elongate handle member 210 when positioned to be substantially coplanar is close to 35 degrees and preferably lies between 30 and 40 degrees.

Figure 9:
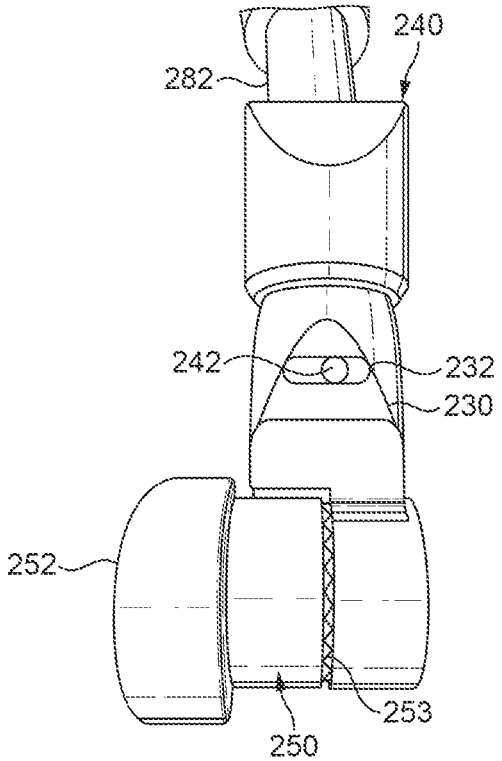
FIG. 9 shows an enlarged view of the hinge and angled joint of the sports training aid of FIGS. 5, 6, 7 and 8 viewed substantially along the axis of the first arm member of the hinge and the elongate handle member.

As shown in FIGS. 9 to 12, the angled joint 240 is integrated with the second arm member 230 of the hinge 250 beyond simply modifying the effective angle of extension of the spacing arm of the spacing member 280. As shown in FIG. 9, the angled joint 240 and the second arm member 230 of the hinge 250 form a rotatable joint, which allows the spacing arm to rotate about the axis of the second arm member 230 relative to the hinge 250 and the elongate handle member 210. The extent of this rotational movement is constrained by the pin-and-slot arrangement shown in FIG. 9, which restricts the rotational movement of the spacing arm relative to the second arm member 230 of the hinge 250.

In more detail, a slot 232 is cut or otherwise formed in the material of the second arm member 230, and a pin 242 connected to the angled joint 240 slides within the slot 232 when the angled joint rotates so as to restrict the extent of motion of the spacing arm as it rotates around the axis of the second arm member 230. More specifically, the inner spacing arm 282 is fixedly connected to the angular joint 240, and the angular joint 240 is able to rotate relative to the second arm member 230 of the hinge 250 until the pin 242 impinges on a side of the slot 232 so as to prevent further rotational movement in that direction.

Figure 10:
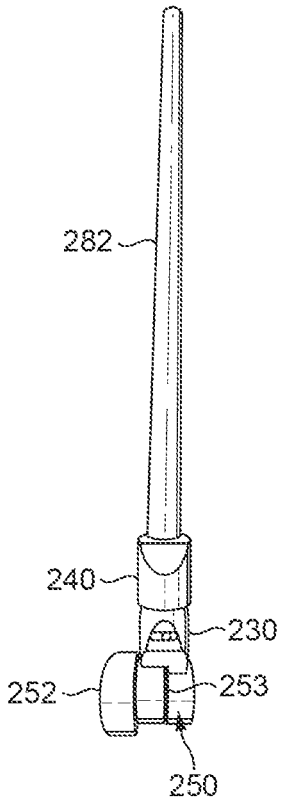
FIGS. 10, 11 and 12 show the sports training aid of FIGS. 5 to 9, with the angled joint shown centred and the spacing arm arranged substantially coplanar with the first and second arm members of the hinge and the elongate handle member (FIG. 10), and with the angled joint permitting the spacing arm to have rotated relative to the hinge and elongate handle member about the axis of the second arm member of the hinge by 14 degrees in each direction from the centred position (FIGS. 11 and 12)

FIG. 10 shows the sports training aid 200 with the angled joint 240 in a centred position, with the pin 242 centrally located within the slot 232, so that the inner spacing arm 282 lies in a common plane together with the first arm 212 and the second arm member 230 of the hinge 250. This demonstrates a centred or neutral position.

Figure 11:
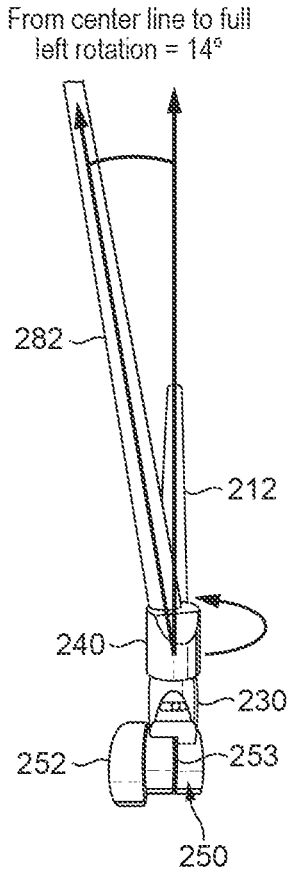
Figure 12:
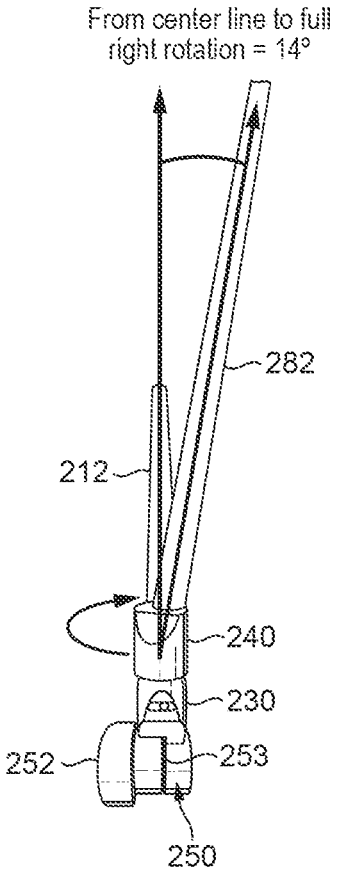

As shown in FIGS. 11 and 12, the inner spacing arm 282 together with the angled joint 240 is able to rotate about the axis of the second arm 230 of the hinge by 14 degrees in each direction, so as to rotate the spacing arm out of the plane of the first and second arm members 212, 230 of the hinge 250 by up to 14 degrees in each direction. Depending on design preferences, the maximum extent of rotation may be in the range from 10 degrees to 20 degrees in each direction, preferably in the range from 12 degrees to 16 degrees in each direction, and more preferably in the range from 13 degrees to 15 degrees in each direction.

The rotational connection between the angled joint 240 and the second arm 230 of the hinge 250 may be set so as to allow free rotation within the permitted range of motion, or may be biased so as to return the spacing arm and angled joint 240 to the centred or neutral position in the absence of any applied force. The latter arrangement provides a feedback system by which the user of the sports training aid 200 can determine when he is applying force against a resistance generated in the rotational joint and the user is able to sense whether it is necessary to apply a greater rotational force via the elongate handle member 210 in order to maintain the desired orientation of the spacing arm relative to the elongate handle member 210.

By allowing the spacing arm to rotate about the axis of the second arm member 230 relative to the hinge 250 and elongate handle member 210, the sportsperson or athlete using the sports training aid 200 is able to practise a number of variations of their swing that represent different shots that they might play with the same club.

Notably, although the rotational motion between the spacing arm and the elongate handle member 210 has been illustrated in FIGS. 10 to 12 by reference to the elongate handle member 210 being held stationary and the spacing arm rotated about the axis of the second arm member 230 of the hinge 250, in practice the user sets the position of the sports training aid 200 in a manner similar to that shown in FIG. 17(*a*) with the rotational joint in the centred or neutral position shown in FIGS. 9 and 10. After setting the initial position, the user then rotates the elongate handle member 210 relative to the spacing arm. Specifically in the context of golf, a golfer is able to adapt their shot by placing their hand position "ahead of" or "behind" the club head. By allowing the elongate handle member 210 to rotate relative to the spacing arm and angled joint 240, the sports training aid 200 can emulate this variation in hand position and incorporate it into the training action or swing to be performed with the sports training aid 200.

Accordingly, this feature of the sports training aid 200 allows different shots to be practiced, or allows a particular aspect of the sportsperson or athlete's swing, stroke or strike to be improved, maintained or modified as part of a training programme. For example, a professional athlete may wish to train to play a variety different of different shots and to practise for each shot type using the sports training aid 200. By contrast, a sportsperson whose swing has a tendency to make their hands unintentionally lead or follow the ball may wish to train to correct this specific aspect of their swing alone, for example by training with over-correction in the opposite sense, or by consciously being able to feel the resistance to their natural hand position due to the bias in the rotational joint when training with the sports training aid 200.

A further adaptation, which may also be employed in the sports training aid 100 of FIGS. 1 to 4, is that the grip portion 220 of the sports training aid 200 is arranged to be able to twist about the axis of the elongate handle member 210, and in the present embodiment about the first arm member 212 of the hinge 250. Again, the grip portion 220 has a neutral or centred orientation, and the grip portion 220 is shaped to define hand positions for the user that are arranged to align the sports training aid 200 in the desired orientation with respect to the user's torso when the grip portion 220 is in the neutral position and the user holds the elongate handle member 210 as intended. Preferably, the grip portion 220 will be biased against any twisting movement and so will tend to return to the centred or neutral position in the absence of any twisting force applied to the grip portion 220.

The grip portion 220 may be configured to twist relative to the rest of the elongate handle member 210 in either direction from the neutral centred position by up to 20 degrees in each direction. Depending on design preferences, the maximum extent of twisting rotation may be in the range from 10 degrees to 30 degrees in each direction, preferably in the range from 15 degrees to 25 degrees in each direction, and more preferably in the range from 18 degrees to 22 degrees in each direction.

For advanced level golfers, it can be desirable to introduce into the golf swing a twisting motion of the wrist. As part of a correctly timed golf swing, this can help to increase the club head speed through the ball and improve shot power and distance. Equally, less advanced golfers may inadvertently twist their wrists during their normal shot action, which causes either "opening" or "closing" of the club face depending on the direction of twisting, and which respectively leads to slicing or hooking the ball when playing a golf shot.

By providing a grip portion 220 that can be twisted against the action of a biasing force or moment, a user can feel their natural tendency twist the club in either direction during the golf swing, in particular relative to the optimum or desired orientation of the virtual club face as indicated by the defined hand positions shaped into the grip portion 220. The user can then train against the resistance provided by the biasing of the grip portion, whether to gain a feel and understanding that allows them to introduce a twisting motion into their golf swing action, or in a desire to eliminate an unwanted twisting motion from their existing or natural golf swing.

Implementing or eliminating such twisting of the club face can be equally important for any golf shot, and indeed such a twisting action can be important in the swing, strike or stroke associated with many different sports. Accordingly, any embodiment of the present invention may be provided with a grip portion capable of being twisted relative to the elongate handle member, and preferably biased against such twisting motion so as to tend to return to a neutral position in the absence of any twisting force.

Figure 16:
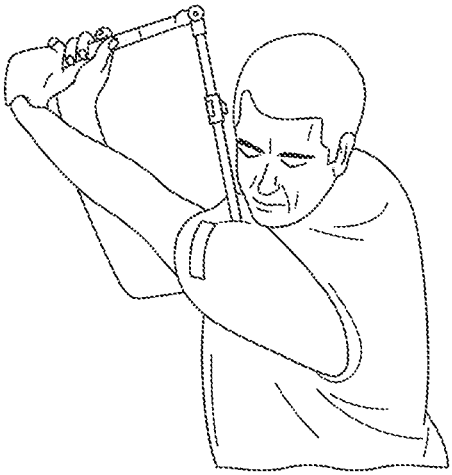
FIG. 16 shows a sportsperson using an embodiment of a sports training aid as shown in FIGS. 1 to 4 in a training exercise, with the positioning piece of the sports training aid held against the user's torso.

A training sequence for using the sports training aid 100 of FIGS. 1 to 4 or the sports training aid 200 of FIGS. 5 to 12 is shown in FIGS. 16 and 17.

With reference to FIG. 17(*a*), it can be seen how the sportsperson or athlete adopts an initial set position using the sports training aid. The sports training aid is held in the defined grip portion of the elongate handle member, with the elongate handle member extending upward and forwards from the user's hands. The two-handed grip adopted by the user is predetermined by the shape of the grip portion, and the length of the spacing member is set so that with the user's arms straight the positioning piece is held in contact with the user's torso, at a position adjacent the user's left armpit (for a right-handed sportsperson or athlete, or the right armpit for a left-handed sportsperson or athlete).

The sportsperson or athlete then rotates in a defined backswing of the sporting action, to adopt the position shown in FIGS. 17(*b*) and (*c*), which are the same position seen from two different directions. This is known as the load phase of the sporting action, as the sportsperson or athlete rotates their torso and coils up, ready to uncoil in the swing, stroke, strike or similar sporting action.

As seen in enlarged view in FIG. 16, the sports training aid in this example helps to fix a radius of the user's left arm (for a right-handed user, or the right arm for a left-handed user). Many sportspeople or athletes have a tendency to bend their arm at the peak of the load phase, and the sports training aid of the present invention encourages them to maintain a greater arm extension. Maintaining arm extension will help to ensure the swing radius is maximised during the swing, stroke or strike, giving a greater head speed to the club, racquet, bat, or similar sporting equipment. This in turn can deliver greater shot power or distance.

It can also be seen that constraining the range of motion of the user's arms by having a fixed grip position relative to the torso means that the sportsperson or athlete is forced to rotate their torso and bend through their legs as shown in FIGS. 17(*b*) and (*c*) (while keeping their head and feet still to maintain position). This in turn encourages a preferred rotational motion through the user's trunk, and a desirable loading through the user's feet, which can translate into an improved overall swing or sporting action.

FIG. 17(*d*) shows the initial unloading phase, transitioning from the load position of Figures (b) and (c) at the start of the downswing. The sports training aid helps to maintain extension of the left arm (for a right-handed user, or the right arm for a left-handed user) as the user applies force through the elongate handle member and begins to uncoil, at the same time uncoiling their trunk and transferring weight onto their front foot in order to translate forces and power from their legs, through their trunk and arms, and into the sporting action or swing.

The sports training aid described above is primarily intended for use in training exercises for the initial load phase of the swing as shown in the sequence of FIGS. 17(*a*) to 17(*d*). Training for this particular portion of the overall sporting action of course affects the overall swing pattern. By training for a consistent motion in this portion of the swing, it can be seen that new behaviour patterns can be learned that affect not only the hand and arm position through the swing, but also the delivery of forces and power through the sportsperson or athlete's feet, pelvis and trunk. With appropriate focus of the training programme, the sportsperson or athlete can perform a repeatable motion or sequence of motions that is targeted to improve, maintain or modify different characteristics of the overall sporting action, as understood from the foregoing.

It is furthermore contemplated to provide a modular sports training aid that includes a an elongate handle member formed substantially the same as the elongate handle members of the embodiments of FIGS. 1 to 4 and 5 to 12, and having a handle connector part at one end. The training aid further includes one or more modular training members each having a training member connector part that is disconnectably connectable to the handle connector part. When connected together, each combination of a training member and the elongate handle member forms a sports training aid.

The connector parts may form part of the hinge 150 or 250 of the embodiments described above, or may be incorporated into the elongate handle member 110 or 210 or into the spacing member 180 or 280, to form such a modular sports training aid. The specific form of the connector parts is open to wide variation and is not particularly specified. As one example, the hinge locking mechanism 152 or 252 may be configured to allow both sides of the hinge to be separated, each side of the hinge forming a connector part.

Such a modular training aid would allow different modular training members to be attached to the same elongate handle member to facilitate different training exercises associated with different portions of the sports action to be practised. As an immediate example, a modular training member corresponding to the spacing member 180 of the embodiment of FIGS. 1 to 4 and a modular training member corresponding to the spacing member 280 of the embodiment of FIGS. 5 to 12 could both be configured to be connected to a common modular handle member 110 or 210, thereby allowing the sports training aid to be used with the spacing member 180 for practising a standard golf swing and a driver golf swing, and to be used with the spacing member 280 for practising pitching golf shots.

Figure 13:
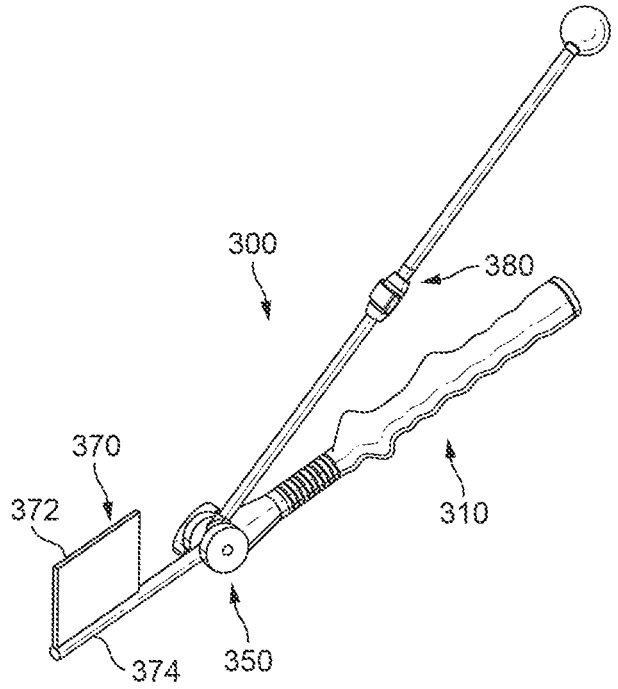
FIG. 13 shows a sports training aid having an alignment or face indicator substantially aligned with the elongate handle member and projecting from the hinge.
Figure 14:
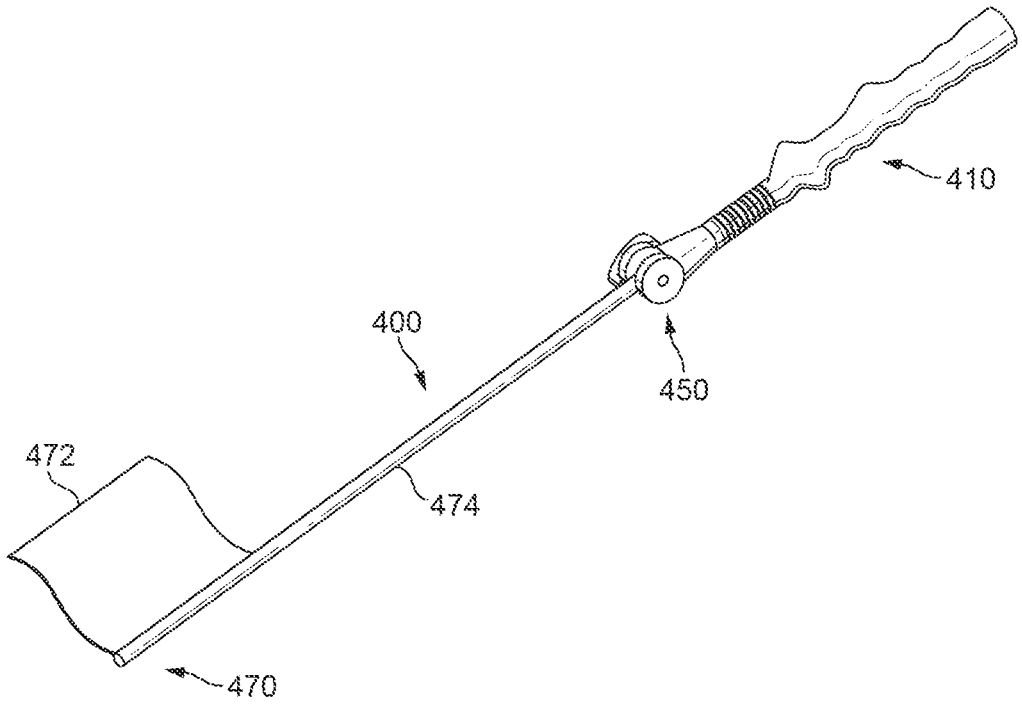
FIG. 14 shows a sports training aid having a shaft extending from the hinge substantially aligned with the elongate handle member, with a flag mounted at or near the end of the shaft furthest from the elongate handle member.
Figure 15:
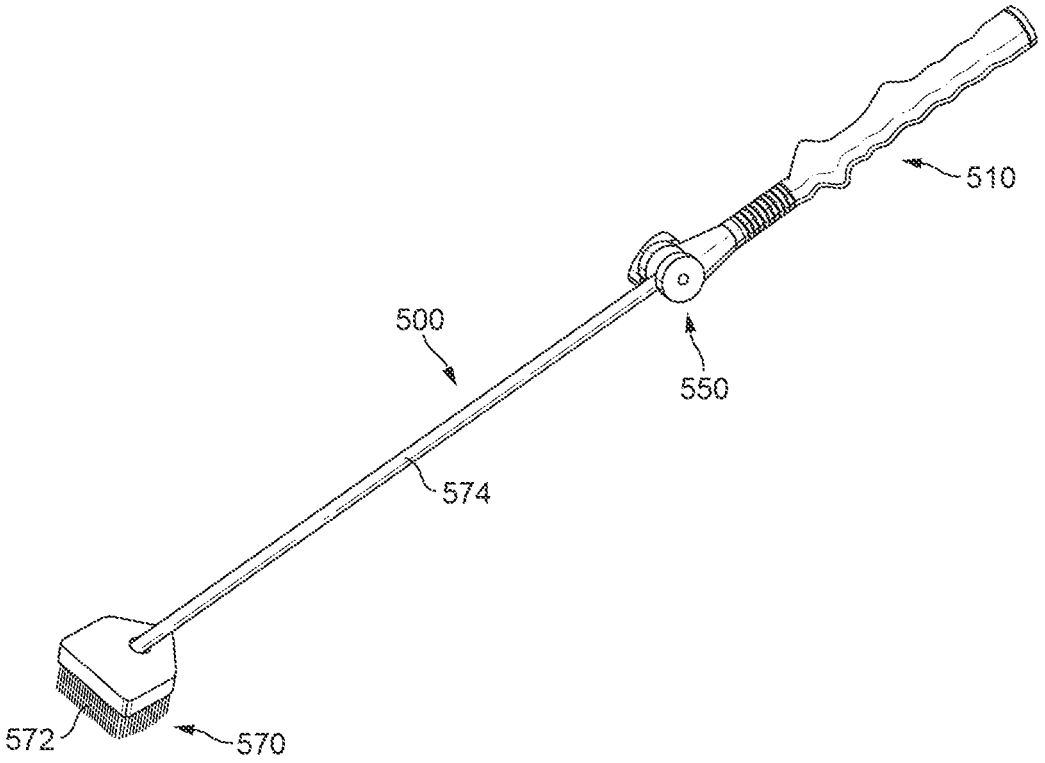
FIG. 15 shows a sports training aid having a shaft extending from the hinge substantially aligned with the elongate handle member, and having a brush mounted at the end of the shaft furthest from the elongate handle member.

Referring to FIGS. 13 to 15, additional modular training members are contemplated.

FIG. 13 shows a modular sports training aid 300 having a modular handle member 310 and a modular training member 380 including a spacing member, which are connected to form a sports training aid in accordance with the embodiment of FIGS. 1 to 4, the modular sports training aid 300 having an additional modular training member 370 connected thereto in the form of a face indicator. The face indicator is simply formed as a panel 372 on a short shaft 374 that is aligned with the elongate handle member 310 so as to extend from the hinge 350 and indicate the facing direction of the club or other racquet, bat or similar equipment. By observing the orientation of the face indicator, the user can determine whether the face of the club, racquet, bat or similar is correctly aligned with the intended facing direction thereof at the critical (e.g., ball striking) part of the stroke, or whether their swing, stroke, strike or other sporting action is being mistimed and/or misdirected.

The face indicator modular training member 370 of FIG. 13 may be connected alone to a modular handle member 310 or may be used in combination with a modular training member corresponding to the spacing member 180 or 280 of the embodiments of FIG. 1 to 4 or 5 to 12.

Further modular training members are shown in FIGS. 14 and 15 connected in each case to an identical modular handle member 410, 510.

The modular training member 470 in FIG. 14 includes a shaft 474 extending from the hinge 450 or other connector part and aligned with the axis of the elongate handle member 410. A flag 472 is mounted at or near the end of the shaft 474 furthest from the elongate handle member 410. The flag 472 is formed from a material having some resilience, such that when a swinging action is performed with the sports training aid 400 the flag will flutter in an audible way. The sound created is a whipping or cracking sound that changes with the speed of the motion, and allows the human ear to discern at what point in the swing, stroke or strike the end of the shaft, where the flag is mounted, reaches its peak speed. Ideally, this should be at or just after the desired point of contact, for example, of the club, bat or racquet with a ball.

The sports training aid 400 having such a modular training member 470 gives auditory feedback that will allow the sportsperson or athlete to determine where in their swing, stroke or strike they are achieving peak speed, and allow them to modify their sporting action in order potentially to get better timing of the overall action and to allow the swing, stroke or strike to be smoother and more efficient and effective.

The modular training member 570 in FIG. 15 includes a shaft 574 extending from the hinge 550 or other connector part and aligned with the axis of the elongate handle member 510. A brush 572 is mounted at the end of the shaft 574 furthest from the elongate handle member 510.

The brush 572 includes bristles that are intended to contact the ground or floor as part of the swing, stroke or strike to be practised using the sports training aid 500. The length of the shaft 574 is selected accordingly, and may be adjustable in length in order to adapt the sports training aid 500 for use by different sized sports persons or athletes.

The brush modular training member 570 is intended to allow the brush simply to skim the floor, to practise striking cleanly through a ball without impacting the ground, and gives auditory and physical feedback to the user.

Different types of bristles may also be used in the brush 572 to simulate striking a ball lying in different ground conditions, as may frequently be encountered in golf, for example. In this regard, longer flexible bristles might appropriately emulate striking through sand in a bunker, while wider shorter bristles might emulate striking through thick rough or long grass. When playing such a shot, the virtual club head can become twisted by the action of the ground on the brush 572, and the user is therefore able to practice swinging through the motion with the modular training member 570 using "strong wrists" to resist unwanted turning of the brush 572 or club head prior to impacting the ball.

Figure 18:
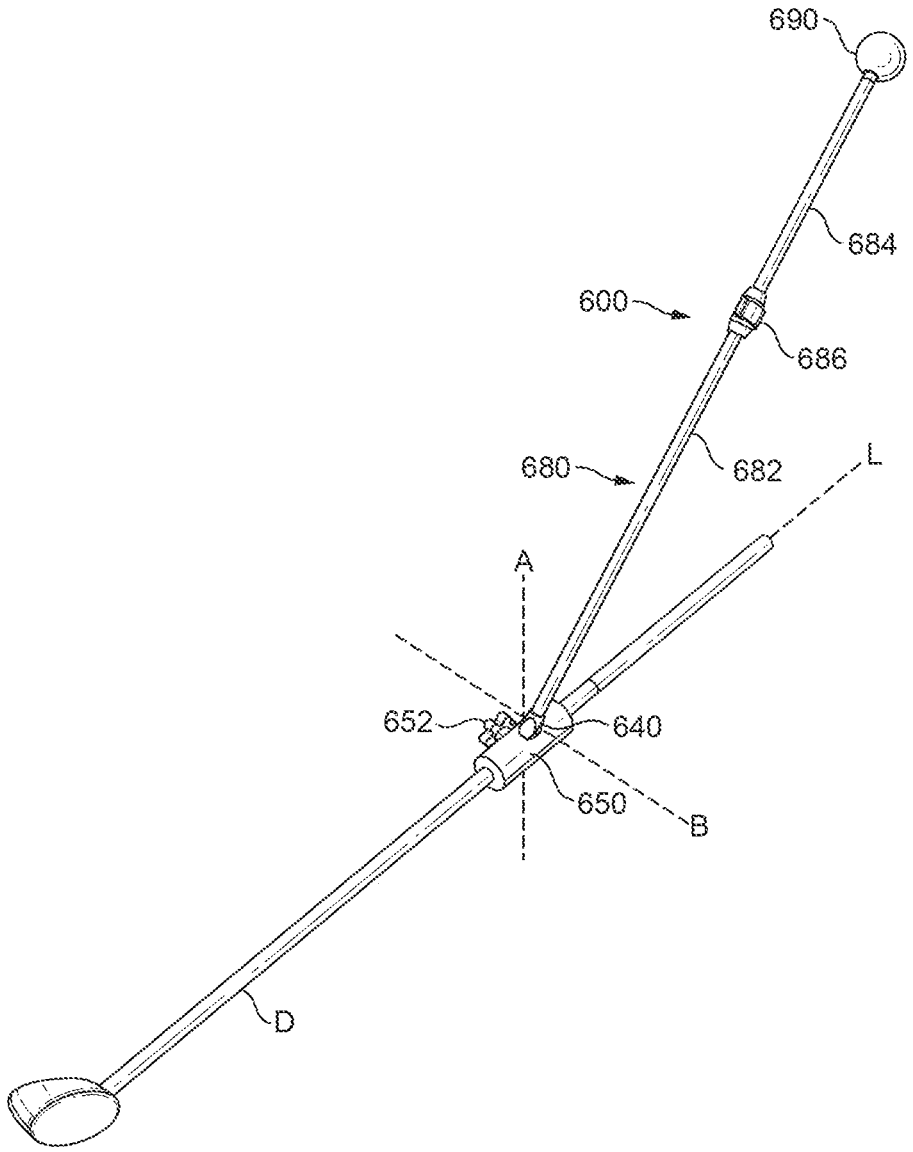
FIG. 18 shows an embodiment of a sports training aid according to the present invention that is configured to be attached to a golf club for use in practising a golf swing.

Turning to FIG. 18, another embodiment of a sports training aid 600 according to the present invention is shown. The sports training aid 600 differs in construction from those described above with reference to FIGS. 1 to 15, but can provide similar functionality.

The primary difference in this embodiment is that no elongate handle member is used. Instead, the sports training aid attaches directly to the shaft of a golf club, which in FIG. 18 is a driver D. In the embodiment of FIG. 18, the attachment is via an attachment member 650 that securely grips the shaft of the golf club immediately or closely below the rubberised grip, although other attachment positions are possible. Locking mechanism 652 is provided for attaching and releasing the attachment member 650 from the golf club. Different golf clubs, such as drivers, irons and pitching wedges may therefore be interchanged for use with the sports training aid 600 by attaching the sports training aid to their respective shafts as desired.

The sports training aid 600 further includes a spacing member 680 which extends from the attachment member 650. The spacing member includes an angled joint 640 which connects the spacing member 680 to the attachment member 650 and sets an internal angle between the axis L of the shaft of the golf club D and the line of extension of the spacing member. In preferred embodiments, the internal angle is adjustable, for example via a locking hinge member incorporated into the angled joint. This allows the internal angle to be adjusted about the axis B shown in FIG. 18, perpendicular to axes A and L, as appropriate for use of the sports training aid 600 with different golf clubs. The internal angle may preferably be set or be able to be set in the range from 30 to 40 degrees and preferably substantially equal to 35 degrees, as may be used with a pitching wedge, and/or in the range from 45 to 55 degrees and preferably substantially equal to 50 degrees, as may be used with golfing irons, and/or in the range from 60 to 70 degrees and preferably substantially equal to 65 degrees, as may be used with a driver.

As in previous embodiments, the spacing member 680 is preferably adjustable in length and, in this example, includes an inner spacing arm 682 and an outer spacing arm 684 that is disposed about the inner spacing arm 682 and is arranged to slide telescopically relative thereto. Other mechanisms are possible for adjusting the length of the spacing member, and embodiments are also contemplated in which the spacing member 680 is of a fixed length. An adjustable length spacing member is nevertheless preferred to accommodate users of different sizes and use of the sports training aid 600 by the same user with different clubs, when the internal angle is varied as described above.

The spacing member terminates in a positioning piece 290, which as before is preferably a ball or ball-shaped for the same reasons previously explained. The positioning piece may be formed separately from or integrally with the rest of the spacing member 680, and is preferably a separate piece connected to the end of the outer spacing arm 684.

The angled joint 640 may also be mounted to the attachment member 650 so as to permit rotation relative to the attachment member 650 about an axis A in the vertical plane as shown in FIG. 18. This enables the spacing member to be rotated in and out of the plane containing the axes A and L, relative to the attachment member 650 and golf club D, in a similar manner as shown for the spacing member 280 in FIGS. 10 to 12. Again, the angled joint 640 is preferably biased against rotation about the axis A so as to tend to return to the centred position, and may permit a limited range of motion of the spacing member about the axis A, for example by a maximum amount in the range from 10 degrees to 20 degrees in each direction, preferably by a maximum amount in the range from 12 degrees to 16 degrees in each direction, more preferably by a maximum amount in the range from 13 to 15 degrees in each direction, most preferably by a maximum amount of 14 degrees in each direction.

The attachment member 650 may also be configured to attach to the golf club D in such a way as to permit the golf club to be twisted about the longitudinal axis L of the shaft relative to the attachment member 650 and the spacing member 680. This mimics the function of the twistable grip portion described above with respect to the previous embodiments. The attachment member 650 is again preferably biased against this relative twisting motion, so as to tend to return the golf club shaft to its original, untwisted position. As before, depending on design preferences, the maximum extent of twisting rotation may be in the range from 10 degrees to 30 degrees in each direction, preferably in the range from 15 degrees to 25 degrees in each direction, and more preferably in the range from 18 degrees to 22 degrees in each direction.

The invention claimed is:

1. A sports training aid comprising two arm members joined together at a join, a first of the two arm members extending from the join as an elongate handle member and the second of the two arm members extending from the join as a spacing member and defining a line of extension from the join to a positioning piece, wherein the arms are joined so that an angle between the handle member and the line of extension is set or is able to be set to a predetermined angle, wherein the elongate handle member includes a grip portion that is able to twist relative to the rest of the elongate handle member, the grip portion being biased against the relative twisting so as to return to an untwisted position in the absence of any net twisting force applied to the grip portion.

2. The sports training aid of claim 1, wherein the grip portion is a defined grip portion being shaped to provide one or more hand positions to facilitate a user in gripping the handle member at a predetermined position on the handle member and with a predetermined orientation of the handle member.

3. The sports training aid of claim 1, wherein the spacing member is adjustable to vary the length of the line of extension, the distance being variable from a minimum length ranging from 35-cm to 50-cm to a maximum length ranging from 70-cm to 100-cm.

4. The sports training aid of claim 1, wherein the spacing member includes an elongate shaft that is telescopically adjustable in length with a locking mechanism to fix the shaft at a desired adjusted length.

5. The sports training aid of claim 1, wherein the sports training aid is configured for the positioning piece to be held in contact with a torso of a user when the user holds the handle by the grip portion, the positioning piece being a ball.

6. The sports training aid of claim 1, wherein the join is an adjustable member operable to adjust an angle between the two arms and to set the two arms at the predetermined angle, wherein the adjustable member is a hinge that is rotatably adjustable and can be locked to set the two arms at the predetermined angle.

7. The sports training aid of claim 1, wherein the predetermined angle is substantially equal to 35-degrees.

8. The sports training aid of claim 1, wherein:

the elongate handle member extends from the join along a first axis;

the spacing member includes a spacing arm extending from the join to the positioning piece to define a second axis as the line of extension from the join to the positioning piece; and the first and second axes are substantially coplanar and the predetermined angle is the angle between the first axis and the second axis.

9. The sports training aid of claim 8, wherein the grip portion is a defined grip portion being shaped to provide one or more hand positions to facilitate a user in gripping the handle member at a predetermined position on the handle member and with a predetermined orientation of the handle member.

10. The sports training aid of claim 8, wherein the grip portion is able to twist about the first axis relative to the rest of the elongate handle member.

11. The sports training aid of claim 8, wherein the spacing member may be adjustable to vary the length of the second axis from the join to the positioning piece, the length being variable from a minimum length in the range from 35-cm to 50-cm to a maximum length in the range from 70-cm to 100-cm.

12. The sports training aid of claim 8, wherein the spacing arm includes an elongate shaft that is telescopically adjustable in length with a locking mechanism to fix the shaft at a desired adjusted length.

13. The sports training aid of claim 8, wherein the sports training aid is configured for the positioning piece to be held in contact with a torso of a user when the user holds the handle by the grip portion, the positioning piece being a ball.

14. The sports training aid of claim 8, wherein the elongate handle member and the spacing member are joined by an adjustable member at the join operable to adjust the angle between the elongate handle member and the spacing member and to set a desired fixed angle with the range of the predetermined angle between the handle member and the spacing member, wherein the adjustable member is a hinge that is rotatably adjustable and can be locked to set the handle member and the spacing member at the desired fixed angle.

15. The sports training aid of claim 8, wherein the predetermined angle is substantially equal to 35-degrees.

16. The sports training aid of claim 1, further comprising a shaft extending from the join and having an end spaced apart from the join.

17. The sports training aid of claim 16, further comprising a panel at the end of the shaft, the panel is configured to represent a facing direction of a club, a racquet, a bat, or similar equipment to determine whether the facing direction is correctly aligned with an intended facing direction thereof at a critical point of a swing, a stroke, a strike, or other sporting action is being mistimed, misdirected, or both mistimed and misdirected.

18. The sports training aid of claim 1, wherein the predetermined angle ranging from 30-degrees to 40-degrees.

19. A sports training aid comprising two arm members joined together, a first of the two arm members extending from the join as an elongate handle member and the second of the two arm members extending from the join as part of a spacing member and defining a line of extension from the join to a positioning piece, wherein the arms are joined so that an angle between the handle member and the line of extension is set or is able to be set to one or more predetermined angles, wherein the elongate handle member includes a defined grip portion that is able to twist about an axis of the handle member relative to the rest of the handle member, the defined grip portion is biased against the relative twisting so as to return to an untwisted position in the absence of any net twisting force applied to the defined grip portion.

20. The sports training aid of claim 19, wherein the join includes an adjustable member operable to adjust the angle between the arm members and to set the angle between the handle member and the line of extension to the predetermined angle, and the adjustable member is a hinge that is rotatably adjustable and can be locked to set the angle between the handle member and the line of extension at the predetermined angle.

* * * * *